United States Patent [19]

Lee

[11] Patent Number: 4,971,708

[45] Date of Patent: Nov. 20, 1990

[54] EMULSION FOR TREATMENT OF CELLULOSE FILAMENTS AND METHOD FOR PREPARATION OF CELLULOSE FILAMENTS WITH USE OF THE EMULSION

[75] Inventor: Sung-In Lee, Busan, Rep. of Korea

[73] Assignee: Sung-Sik Lee, Busan, Rep. of Korea

[21] Appl. No.: 422,501

[22] Filed: Oct. 17, 1989

Related U.S. Application Data

[63] Continuation-in-part of Ser. No. 316,795, Feb. 28, 1989, abandoned.

[30] Foreign Application Priority Data

Jan. 1, 1987 [KR] Rep. of Korea ..... 169

[51] Int. Cl.[5] ..... D06M 13/00

[52] U.S. Cl. ..... 252/8.6; 252/8.8; 252/8.9

[58] Field of Search ..... 252/8.8, 8.9, 8.6

[56] References Cited

U.S. PATENT DOCUMENTS

| | | | |
|---|---|---|---|
| 3,977,979 | 8/1976 | Crossfield | 252/8.8 |
| 4,092,107 | 5/1978 | Beck | 8/116 R |
| 4,438,001 | 3/1984 | Suzuki | 252/8.7 |
| 4,552,671 | 11/1985 | Ogiso | 252/8.9 |

*Primary Examiner*—John F. Niebling
*Assistant Examiner*—Isabelle R. McAndrews
*Attorney, Agent, or Firm*—Paul M. Denk

[57] ABSTRACT

In the composition and method of treatment of cellulose filaments, the emulsion that is applied to the filaments after spinning, but before drying, includes, in combination, a cone oil, a surface active agent, such as of alkyl polyamine derivatives or polyoxyethylene alkyl ether type agent, a positive ion water solution for alkyl polyamine derivative, polyoxyethylene alkyl ether type surface active agent, urea resin, a resinfication catalyzer, and water, and after treatment of the filaments with said emulsion, subsequent to their spinning, said treated filaments then being dried in a tunnel type dryer, in a high frequency heating type dryer, to provide filaments having reduced shrinkage, and lower-swelling characteristics during application and usage.

9 Claims, No Drawings

EMULSION FOR TREATMENT OF CELLULOSE FILAMENTS AND METHOD FOR PREPARATION OF CELLULOSE FILAMENTS WITH USE OF THE EMULSION

CROSS REFERENCE TO RELATED APPLICATION

This application is a continuation-in-part application of U.S. patent application Ser. No. 07/316,795, filed Feb. 28, 1989, abandoned Dec. 4, 1989.

BACKGROUND OF THE INVENTION

The present invention relates to an emulsion for the treatment of cellulose filaments after spinning and a method for the preparation of cellulose filaments with use of the emulsion.

Usually, in the preparation of viscose rayon filaments by a centrifugal spinning process, the cake is treated with an emulsion, dehydrated and then dried in a tunnel drier for 70 to 100 hours. The cake should be dried at a low temperature under a high moisture to be dried uniformly throughout its inside and outside. Generally, the external part of the cake is wound densely under tension so that it is difficult to shrink during drying and tends to form internal strain when dried suddenly, while the internal part of the cake is wound under low tension so that it tends to shrink by drying and forms no internal strain. Accordingly, the quality of the filaments is largely affected by the drying temperature and the drying speed.

Accordingly, by a rapid drying method, the surface of the cake is easily dried to form a shrinking force. However, since the surface of the cake cannot shrink freely, it is dried under tension to form internal strain. Further, the shrinkage is uneven between the inside and the outside of the cake, and resultantly a difference in fineness between them occurs. In some cases, a high frequency heating system is used to dry uniformly the cake throughout its inside and outside, but it requires disadvantageously a high manufacturing cost.

Conventionally, a nonionic emulsion or a mixture of a nonionic emulsion and an anionic emulsion has been used for the emulsion treatment of cellulose filaments after spinning, and recently with the high development of surface active agents an anionic or a nonionic emulsion or their combination has been used as the base in many cases. However, no cationic surface active agent has been used.

An object of the present invention is to provide an emulsion for treatment of cellulose filaments such as viscose rayon filaments and acetate filaments after spinning, which reacts easily with cellulose molecule in the amorphous area of the fiber and thus lowers its swelling degree and makes free shrinkage possible along the progress of drying.

Another object of the present invention is to provide a method for preparation of an excellent filament having uniform fineness, smooth surface, naturally increased twist and increased tensile strength by using such an emulsion.

SUMMARY OF THE INVENTION

The emulsion according to the present invention contains 0.4 to 4% by weight of a cone oil, 0.001 to 0.04% by weight of a mixed liquid of an alkyl polyamine derivative type cationic surface active agent and a polyoxyethylene alkyl ether type surface active agent, 0.02 to 0.5% by weight of an urea resin and 0.0001 to 0.025% by weight of a resinification catalyst in water. The emulsion is applied to cellulose filaments after spinning and then dried in a tunnel drier.

DETAILED DESCRIPTION OF THE INVENTION

According to the present invention, the mixture of an alkyl polyamine derivative type surface active agent and a polyoxyethylene alkyl ether type surface active agent penetrates into the interior of the cellulose filament and is dispersed in it to exert catalytic activity and thus the urea resin penetrates into the amorphous area of the fiber or filament and reacts rapidly with the fiber molecule (bond or crosslink) to form filaments of low swelling.

The emulsion of the present invention contains the following components (1) to (4) in water. The percentages show the ratio based on the total amount of the treating liquid.

(1) Cone oil: 0.4 to 4%

Usually, it is preferred to use 0.4 to 1% for viscose rayon filament and 2 to 4% for diacetate filament. For example, MultiCone NP 2 made by Tar Cone Oil Co. of U.K. may be used. A W/O type corn oil which vaporizes at a temperature not lower than 130° C. is converted to O/W type for use.

(2) Surface active agent (Wetting agent): 0.0001 to 0.4%

It is a mixture of an alkyl polyamine derivative cationic surface active agent and a polyoxyethylene alkyl ether type surface active agent. For example, a mixture of Zontes TA-460-12(20) and Actinol R-100 (mixing ratio of 100:1) made by Matsumoto Yushi Seiyaku Co. of Japan may be used.

(3) Urea resin: 0.02 to 0.5%

For example, a urea resin of low condensation (dimethylol urea resin) may be used. Usually, it is preferred to use 0.02 to 0.25% for viscose rayon filament and 0.04 to 0.5% for diacetate filament.

(4) Catalyst: 0.0001 to 0.025%

It is preferred to use an organic acid such as acetic acid as the resinification catalyst.

The method for preparation of cellulose filaments with the use of the emulsion according to the present invention will be illustrated in detail for each viscose rayon filament and diacetate filament as follows.

(A) For viscose rayon filament

In the emulsion treatment of the cake of viscose rayon filaments after spinning, the cake is treated with the above-mentioned emulsion and then dehydrated and dried in a tunnel drier.

The cake filament shrinks freely in the tunnel drier and the cake is dried uniformly throughout its inside and outside to give fibers of high quality.

It will be throught that the effect can be obtained as follows: by the penetrating and dispersing activity of the two surface active agents (alkyl polyamine derivative surface active agent and polyoxyethylene alkyl ether type surface active agent) comprised in the emulsion, the urea resin comprised in the emulsion penetrates into the amorphous area of the filament and is bound or crosslinked to the cellulose molecule of the filament to form filaments having a lower swelling.

It has been found that the emulsion of the present invention shows higher penetration and dispersion when its pH is adjusted to about 6 by using an organic acid (such as acetic acid) as the catalyst to facilitate the binding reaction. The urea resin floating on the surface of the filament is dispersed uniformly in the amorphous area of the filament by the penetrating and dispersing activity of the polyoxyethylene alkyl ether type surface active agent (for example, Actinol R-100) to bind with cellulose molecule. The performance of the surface active agent is exerted effectively by susing the two agents in combination. An appropriate amount of the urea resin is used to bind effectively the methylol group of the urea resin with hydroxyl group of cellulose molecule not to leave unreacted resin.

The filament in the cake shrinks with the drying process because it is wound drawn during spinning.

With the drying process, the moisture penetrated into the amorphous area of the fiber begins to vaporize, and the surface active agent (Zontes TA-46-12(20)) used for the penetration and dispersion of the urea resin and cone oil ooze out of the fiber surface. Along the progress of drying, the surface active agent oozed out of the fiber surface adheres on the fiber surface or is bound to the hydroxyl group of cellulose molecule of the fiber at its amine group to act as a softening lubricant together with cone oil and to lay down the fluffs on the surface of the filament.

As the methylol group NH. $CH_2OH$ of the urea resin and the hydroxyl group of cellulose molecule bind together, the swelling of the fiber is lowered. The resinification proceeds as the drying progresses and the volume of the fiber is lowered according to the shrinking of the fiber. Especially when the volume of amorphous area of the fiber decreases, the surface active agent and cone oil remained in this area ooze out of the surface of the fiber during evaporation of moisture and adheres to the surface of the fiber. Thus, they act as the softening lubricant of the surface of the fiber and lays down the fluffs formed on the surface and adheres them to the surface and also prevents new formation of fluffs.

Thus, the filaments of the cake densely and tightly wound are separated each other easily according to the decrease in volume and the lubricating property of the surface active agent and cone oil deposited on the surface of the filament to become shrinkable freely. Hence, the fineness of the filament on the outside of the cake wound thin in a drawn condition increases gradually and the fineness becomes uniform throughout the inside and outside. The twist given during spinning increases automatically by the free shrinkage. (See Table 1.)

Thus, a path of moisture evaporation is open from the outside to the inside of the cake, and the free shrinkage and drying of the filament are performed successively and viscose rayon filaments of uniform fineness, fluff-free and good quality are manufactured.

Equations for the chemical reactions of binding and crosslinking between the urea resin and cellulose filament are shown as follows:

Binding

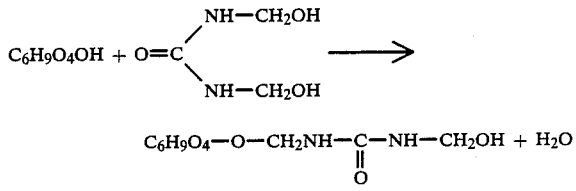

Crosslinking

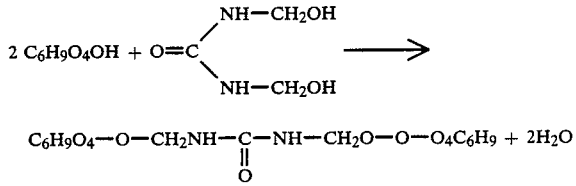

Conventionally, in the centrifugal spinning process, the cake is dried in a tunnel drier for approximately 70 to 100 hours and then stood at room temperature for about 12 hours and then, 1 used as it is, or
2 rewound into skein or cone for use.

The cake treated with the emulsion of the present invention may be also dried in a tunnel drier for approximately 70 to 100 hours to be shrinked freely and then stood at room temperature for 12 hours and then, 1 used as it is, or
2 rewound into skein or cone for use. By drying the cake with free shrinkage, the filaments having uniform fineness and good quality can be obtained.

Further, in the drawing during rewound into cone, the orientation of cellulose molecules binding in the amorphous area is improved. In the case the cake is rewound into cone, cone oil is deposited uniformly on the surface of the filament on which the emulsion of the present invention is applied and accordingly an additional application of cone oil is not required due to the lubricating property of the surface active agent deposited on the surface of the filament.

EXAMPLE 1

Viscose rayon filaments (120 deniers) manufactured by Wonjin Rayon Co., Ltd. (Korea) were treated after spinning with an emulsion according to the present invention and a conventional emulsion manufactured by Wonjin Rayon Co., Ltd. (Comparative Example). The properties of the products were examined. The test results are shown in Table 1.

As shown in Table 1, the fiber treated with the emulsion according to the present invention (SQ-1) shows a twist approximately 3.7 higher than that given during spinning by free shrinkage, while the fiber treated by the conventional process (Comparative Example) shows a twist about 0.4 lower. It can be seen that the fiber treated with the emulsion of the present invention is apparently more advantageous due to free shrinkage.

TABLE 1

| | | Test results of the emulsions | | | | | |
|---|---|---|---|---|---|---|---|
| | | Sample | | | | | Increase and decrease |
| Item | Standard | A | B | C | D | E | |
| Fine- | 118 ± 2 SQ-1 | 121.8 | 120.7 | 121.0 | 121.2 | 121.2 | +1.2 |

TABLE 1-continued

| Item | Standard | | Test results of the emulsions Sample A | B | C | D | E | Increase and decrease |
|---|---|---|---|---|---|---|---|---|
| ness | | C.E. | 118.5 | 118.5 | 118.7 | 118.6 | | 0 |
| Dry strength | 1.65 or more | SQ-1 | 1.74 | 1.77 | 1.75 | 1.75 | 1.75 | |
| | | C.E. | 1.71 | 1.72 | 1.74 | 1.71 | 1.72 | |
| Dry elongation | 18.0 or more | SQ-1 | 21.2 | 20.2 | 20.4 | 20.6 | 20.6 | |
| | | C.E. | 21.1 | 20.7 | 20.8 | 20.9 | 20.9 | |
| Wet strength | 0.8 or more | SQ-1 | 0.83 | 0.86 | 0.83 | 0.84 | 0.84 | |
| | | C.E. | 0.86 | 0.87 | 0.82 | 0.86 | 0.85 | |
| Wet elongation | 24.0 or more | SQ-1 | 32.4 | 31.2 | 29.9 | 31.2 | 31.21 | |
| | | C.E. | 30.2 | 30.0 | 30.7 | 29.8 | 30.2 | |
| Twist | 80 | SQ-1 | 84.4 | 83.6 | 83.2 | 83.7 | 83.7 | +3.7 |
| | | C.E. | 76.0 | 80.5 | 80.8 | 81.0 | 79.6 | −0.4 |
| Oil content | | SQ-1 | 0.13 | 0.09 | 0.11 | 0.11 | 0.11 | |
| | | C.E. | 0.13 | 0.13 | 0.12 | 0.14 | 0.13 | |

(Notes)
SQ-1: Viscose rayon filaments (120 d) after spinning were treated with the emulsion which was prepared by replacing 0.1% of 0.5% emulsion conventionaly used with the emulsion according to the present invention. The weight ratio is based on the total solution.
C.E.: Comparative Example in which the above viscose rayon filaments were treated with the conventional emultion.

(B) For diacetate filaments (1) Diacetate filaments are treated after spinning with the emulsion by roller methods and wound by each two processes, with and without twisting. In the case the filaments are wound with no twisting by using the emulsion of the present invention, by the penetrating and dispersing activity of with the two surface active agents in the emulsion of the present invention, for example Zontes TA 46-15(20) and Actinol R-100 both made by Matsumoto Yushi Seiyaku Co., the urea resin in rapidly penetrated and dispersed in the interior of the filaments and combined to the acetate molecule to form filaments of lower swelling.

When the acetate filaments treated with the emulsion of the present invention and wound are stood at room temperature (30° C.) for about 12 hours, the drying of the filaments proceeds at room temperature and the resinification of the urea resin bound to the acetate filaments begins and thus the volume of the acetate filaments decreases due to the shrinkability of the filaments. Accordingly, the surface active agent and corn oil ooze out of the surface of the filaments and deposits on it to soften and smooth the surface of the filaments. The fluffs formed during the winding process are laid down on the surface of the fiber and at the same time, by the softening and lubricating property of the surface active agent (Zontes TA-15(20)) and the cone oil (R-100 ) and the decrease in the fiber volume.

1 the fluffs formed during spinning are laid down on the surface of the filament to prevent formation of fluffs, 2 when the diacetate filaments wound with no twist are twisted in a twisting machine, the orientation of bound acetate molecules is improved by the tension of twisting to increase the tensile strength of the filaments.

(2) The binding reaction between methylol group —NH—$CH_2OH$ of urea resin and acetyl group of diacetate filament is as follows.

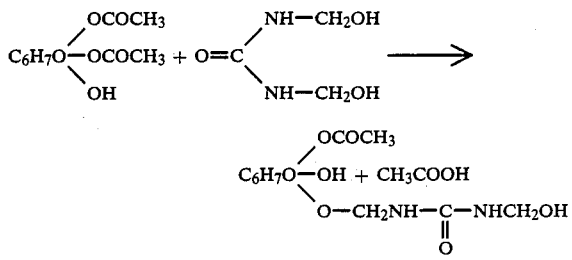

EXAMPLE 2

Acetate filaments manufactured by Sun Kyung Textile Co., Ltd. (Korea) were treated with the emulsion of the present invention, of somewhat higher concentration and wound into cone under tension and the property was examined in comparison to acetate filaments made by Teijin Limited (Japan). The results are shown in Tables 2, 3 and 4. The fibers treated with the emulsion of the present invention are more excellent than Teijin Reczel made by Teijin Co., Ltd.

TABLE 2

| Load | Total shrinkage, TS: Diacetate treated with the emulsion of the present invention 80° C. | 100° C. | 120° C. | Teijin Reezel made by Teijin Limited 80° C. | 100° C. | 120° C. |
|---|---|---|---|---|---|---|
| 1 mg | 2.9 | 2.9 | 1.4 | 2.1 | 0.6 | 0.4 |
| 2 mg | 2.7 | 1.1 | −0.6 | 2.2 | −0.4 | −1.1 |
| 3 mg | 2.6 | 0.9 | −1.8 | 2.3 | −0.6 | −2.5 |
| 4 mg | 2.0 | −0.4 | −3.2 | 1.6 | −1.3 | −4.6 |
| 5 mg | 1.8 | −0.4 | −4.6 | 1.4 | 2.0 | −5.7 |

TABLE 3

| Load | Total percentage crimp, TC: Diacetate treated with the emulsion of the present invention 80° C. | 100° C. | 120° C. | Teijin Reezel made by Teijin Limited 80° C. | 100° C. | 120° C. |
|---|---|---|---|---|---|---|
| 1 mg | 1.3 | 1.8 | 1.1 | 0.6 | 0.6 | 0.6 |
| 2 mg | 0.9 | 0.7 | 0.9 | 0.8 | 0.6 | 0.8 |

TABLE 3-continued

| | Total percentage crimp, TC | | | | | |
|---|---|---|---|---|---|---|
| | Diacetate treated with the emulsion of the present invention | | | Teijin Reezel made by Teijin Limited | | |
| Load | 80° C. | 100° C. | 120° C. | 80° C. | 100° C. | 120° C. |
| 3 mg | 1.3 | 1.1 | 1.3 | 1.4 | 1.1 | 1.3 |
| 4 mg | 0.7 | 0.6 | 1.5 | 0.9 | 1.1 | 0.9 |
| 5 mg | 1.1 | 0.4 | 1.3 | 1.1 | 1.1 | 1.1 |

TABLE 4

| | Fiber shrinkage, FS | | | | | |
|---|---|---|---|---|---|---|
| | Diacetate treated with the emulsion of the present invention | | | Teijin Reezel made by Teijin Limited | | |
| Load | 80° C. | 100° C. | 120° C. | 80° C. | 100° C. | 120° C. |
| 1 mg | 1.6 | 1.1 | 0.4 | 1.1 | 0 | −0.2 |
| 2 mg | 1.7 | 0.4 | −1.5 | 1.4 | −0.9 | −1.8 |
| 3 mg | 1.1 | −0.2 | −3.0 | 0.9 | −1.6 | −3.7 |
| 4 mg | 0.1 | −0.9 | −4.6 | 0.7 | −2.3 | −5.5 |
| 5 mg | 0.7 | −1.4 | −5.9 | 0.4 | −3.0 | −6.8 |

EXAMPLE 3

Acetate filaments manufactured by Sun Kyung Textile Co., Ltd. were treated, after spinning, with the emulsion of the present invention. The properties of the product, such as perfect twist rate, fluff formation rate and thread breakage rate during twisting were compared to those treated without the emultion of the present invention. The results are shown in Table 5. From these results, it can be found that each of perfect twist rate, fluff formation rate and thread breakage rate during twisting is highly improved with the use of the emulsion of the present invention, 2.5% of which is mixed with the emulsion conventionally used by Sun Kyung Textile Co., Ltd., compared to the case with no use of the emulsion of the present invention.

TABLE 5

| | Perfect twist rate and fluff formation rate | | | |
|---|---|---|---|---|
| Item | Classification | | Inventive process | Conventional process |
| Process conditon | Thread breakage rate (%) | | 2.1 | 10.2 |
| | Product yield (%) | | 95.55 | 95.65 |
| | Perfect twist rate (%) | | 93.5 | 85.7 |
| Product quality | Strength (G) | | 1.181 | 1.175 |
| | Elongation (%) | | 24.7 | 26.3 |
| | O.P.U. (%) | | 1.26 | 1.13 |
| | Friction coefficient | U/S F/F | 0.193 | 0.182 |
| | | U/d 27M | 0.219 | 0.226 |
| | | 60M | 0.229 | 0.241 |
| | | 90M | 0.242 | 0.252 |
| Crell mirror | Fluff formation rate (%) | | 0 | 10 |

Conventional Process

A conventional spinning oil containing 10.5% emulsion was used.

Inventive Process

8% of the above conventional emulsion was mixed with 2. 5% of the emulsion according to the present invention and the mixture was used as 10.5% emulsion. (The weight ratio is based on the total solution.)

As described above, the emulsion according to the present invention easily reacts with cellulose molecules in the amorphous area of the fiber. Resultantly, when the emulsion is applied to cellulose filaments after spinning, the swelling degree of the filaments is lowered and the free shrinkage accompanied with the progress of drying becomes possible. Further, since the two surface active agents comprised in the emulsion act as an agent for smoothing the filament surface by their synergetic effect, a high quality product having uniform fineness, smooth surface and high strength can be obtained by the treatment of the present invention.

What is claimed is:

1. An emulsion for after-treatment of spinning cellulose filaments, which contain 0.4 to 4% by weight of a cone oil, 0.001 to 0.04% by weight of a mixed liquid of an alkyl polyamine derivative type cationic surface active agent and a polyoxyethylene alkyl ether type surface active agent, 0.02 to 0.5% by weight of a urea resin, and 0.0001 to 0.025% by weight of a resinification catalyst in water.

2. An emulsion according to claim 1, in which the mixing ratio of the alkyl polyamine derivative type cationic surface active agent and the polyoxyethylene alkyl ether type surface active agent is 100:1.

3. An emulsion according to claim 1, in which the urea resin is a dimethylol urea resin of low condensation.

4. An emulsion according to claim 1, in which the resinification catalyst is acetic acid.

5. A method for preparation of cellulose filaments having uniform fineness and smooth surface, characterized in that cellulose filaments after spinning are treated with an aqueous emulsion containing 0.4 to 4% by weight of a cone oil, 0.001 to 0.04% by weight of a mixed liquid of an alkyl polyamine derivative type cationic surface active agent and a polyoxyethylene alkyl ether type surface active agent, 0.02 to 0.5% by weight of a urea resin, and 0.0001 to 0.025% by weight of a resinification catalyst and dried in a tunnel drier.

6. A method according to claim 5, in which said mixing ratio of the alkyl polyamine derivative type cationic surface active agent and the polyoxyethylene alkyl ether type surface active agent is 100:1.

7. A method according to claim 5, in which the urea resin is a dimethylol urea resin of low condensation.

8. A method according to claim 5, in which the resinification catalyst is acetic acid.

9. A method according to claim 5, in which acetate filaments wound with no twist are treated with the aqueous emulsion.

* * * * *